US008640687B2

(12) United States Patent
Tucker

(10) Patent No.: US 8,640,687 B2
(45) Date of Patent: Feb. 4, 2014

(54) ENCLOSED SNOW MELT SYSTEM

(76) Inventor: William R. Tucker, Eagle River, AK (US)

( * ) Notice: Subject to any disclaimer, the term of this patent is extended or adjusted under 35 U.S.C. 154(b) by 1293 days.

(21) Appl. No.: 12/391,211

(22) Filed: Feb. 23, 2009

(65) Prior Publication Data

US 2009/0217554 A1 Sep. 3, 2009

Related U.S. Application Data

(60) Provisional application No. 61/030,447, filed on Feb. 21, 2008.

(51) Int. Cl.
*E01H 5/10* (2006.01)

(52) U.S. Cl.
USPC ..... 126/343.5 R; 37/227; 37/228; 37/196; 37/199

(58) Field of Classification Search
USPC ..... 126/343.5 R; 37/196, 199, 227, 228
See application file for complete search history.

(56) References Cited

U.S. PATENT DOCUMENTS

| | | | | | |
|---|---|---|---|---|---|
| 2,327,226 | A | * | 8/1943 | Taylor | 241/186.35 |
| 2,493,210 | A | * | 1/1950 | Woodman | 366/247 |
| 2,696,814 | A | | 12/1954 | Townsend | |
| 2,760,761 | A | * | 8/1956 | Woodman | 366/327.1 |
| 2,760,762 | A | * | 8/1956 | Woodman | 366/314 |
| 3,409,006 | A | * | 11/1968 | Getti | 126/343.5 R |
| 3,452,459 | A | | 7/1969 | Campion | |
| 3,464,128 | A | * | 9/1969 | Krickovich | 37/228 |
| 3,747,587 | A | * | 7/1973 | McKenzie | 126/343.5 R |
| 3,866,340 | A | | 2/1975 | Krickovich | |
| 4,164,820 | A | | 8/1979 | Krickovich | |
| 4,288,931 | A | | 9/1981 | Rhodes | |
| 4,409,957 | A | | 10/1983 | Muhammad | |
| 4,615,129 | A | | 10/1986 | Jackson | |
| 5,199,198 | A | | 4/1993 | Godbout | |
| 6,012,447 | A | * | 1/2000 | Waxler et al. | 126/343.5 R |
| 6,305,105 | B1 | * | 10/2001 | Lowman | 37/228 |
| 6,971,596 | B2 | * | 12/2005 | Monroe | 241/86.1 |
| 7,077,346 | B2 | | 7/2006 | Monroe | |
| 7,318,668 | B2 | * | 1/2008 | Bielozer | 366/331 |
| 2004/0000305 | A1 | | 1/2004 | Molyneaux | |
| 2006/0137677 | A1 | | 6/2006 | Burnett | |
| 2007/0029402 | A1 | | 2/2007 | Rumbaugh | |

FOREIGN PATENT DOCUMENTS

| | | | | |
|---|---|---|---|---|
| JP | 10237836 A | * | 9/1998 | E01H 5/10 |
| RU | 2023786 C1 | * | 11/1994 | |

* cited by examiner

*Primary Examiner* — Kenneth Rinehart
*Assistant Examiner* — Jorge Pereiro
(74) *Attorney, Agent, or Firm* — Christensen O'Connor Johnson Kindness PLLC

(57) ABSTRACT

An upright induction chamber (100) is positioned within a melting tank (24) of a snow melting apparatus (20). The melting tank is filled with melting water. Shredded snow from a hopper assembly (22) is introduced into the upper end of the induction chamber along with heated melting water, to be mixed by an impeller fan pump (110) that is operated to force the melting water at sufficient speed through the induction chamber to overcome the buoyancy of the snow, thereby facilitating uniform distribution of the snow across the induction chamber and good mixing of the snow with the melting water. A portion of the liquid composed of the melted snow and melting water from the induction chamber is expelled from the melting tank, and a portion of the liquid from the induction chamber passes through a heat exchanger (34) positioned within the heating tank to be heated thereby and then re-introduced into the upper portion of the induction chamber.

21 Claims, 7 Drawing Sheets

ENCLOSED SNOW MELT SYSTEM

CROSS-REFERENCE TO RELATED APPLICATION

This application claims the benefit of U.S. provisional patent application No. 61/030,447, filed Feb. 21, 2008, the specification of which is incorporated herein by reference.

TECHNICAL FIELD

The present application pertains to systems, apparatus and methods for melting snow, and more particularly to melting snow removed from roads, parking lots, airports or other locations at the point of collection or at a transfer or collection site.

BACKGROUND

The impact of accumulated snow pack on urban areas subject to severe winter weather results in extensive snow handling costs, for both the public and private sectors, in order to maintain safety and usability of high use facilities such as roads, parking lots and airport facilities. Traditionally, accumulated snow has been loaded and hauled to locations which allow stockpiling until seasonal melting disposes of the problem. In some areas, lacustrine or riverine disposal have been available alternatives. Over time, these options have become increasingly expensive to implement, and often reduced in availability.

Some reasons for the added cost and reduced options include:

1. Urban sites suitable in size and location for stockpiling snow from midwinter through early summer are becoming unavailable as more financially appropriate uses for the real estate emerge.
2. Haul costs have increased, particularly the cost of fuel.
3. Regulation by the Environmental Protection Agency, and others, has increased the cost of operating snow storage areas, and generally eliminated rivers and lakes from disposal options.

Therefore, the ability to dispose of snow by melting, either at the point of collection, or at temporary satellite sites which minimize haul cost, has become an important consideration in both public and private sector snow management.

Two of the major cost factors defining the feasibility of snow melting are labor and fuel. The cost of labor and associated equipment is a function of the production rate of the process. Snow melting machinery, to be successful in the market place, should be built in a range of sizes suitable to the production requirements of the user, thereby allowing the user to project the labor cost component of use. In most cases the labor component should be comparable to the loading costs contingent with customary truck hauling.

The cost of fuel is a function of the efficiency of the snow melting equipment in utilizing the chosen energy source. Efficiency can be measured as the percentage of total consumed energy actually required to produce a specific rise in temperature of the snow mass.

Snow melting machinery presently available in the market place is inefficient from the standpoint of energy conservation for several reasons. Melting chambers open to ambient conditions, for the purpose of snow input, lose significant energy through both convection and radiation. Input of hot water, the typical melting medium, at the surface of the input snow mass, by spraying or flooding, also produces significant convective energy loss. Input of consolidated snow mass to the open melt chamber results in the consolidated mass insulating its inner core from the desired melt heat, thereby retarding the melt rate and increasing the time over which energy will be lost. The snow melting apparatus of the present disclosure seeks to overcome these deficiencies of existing systems and apparatuses.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
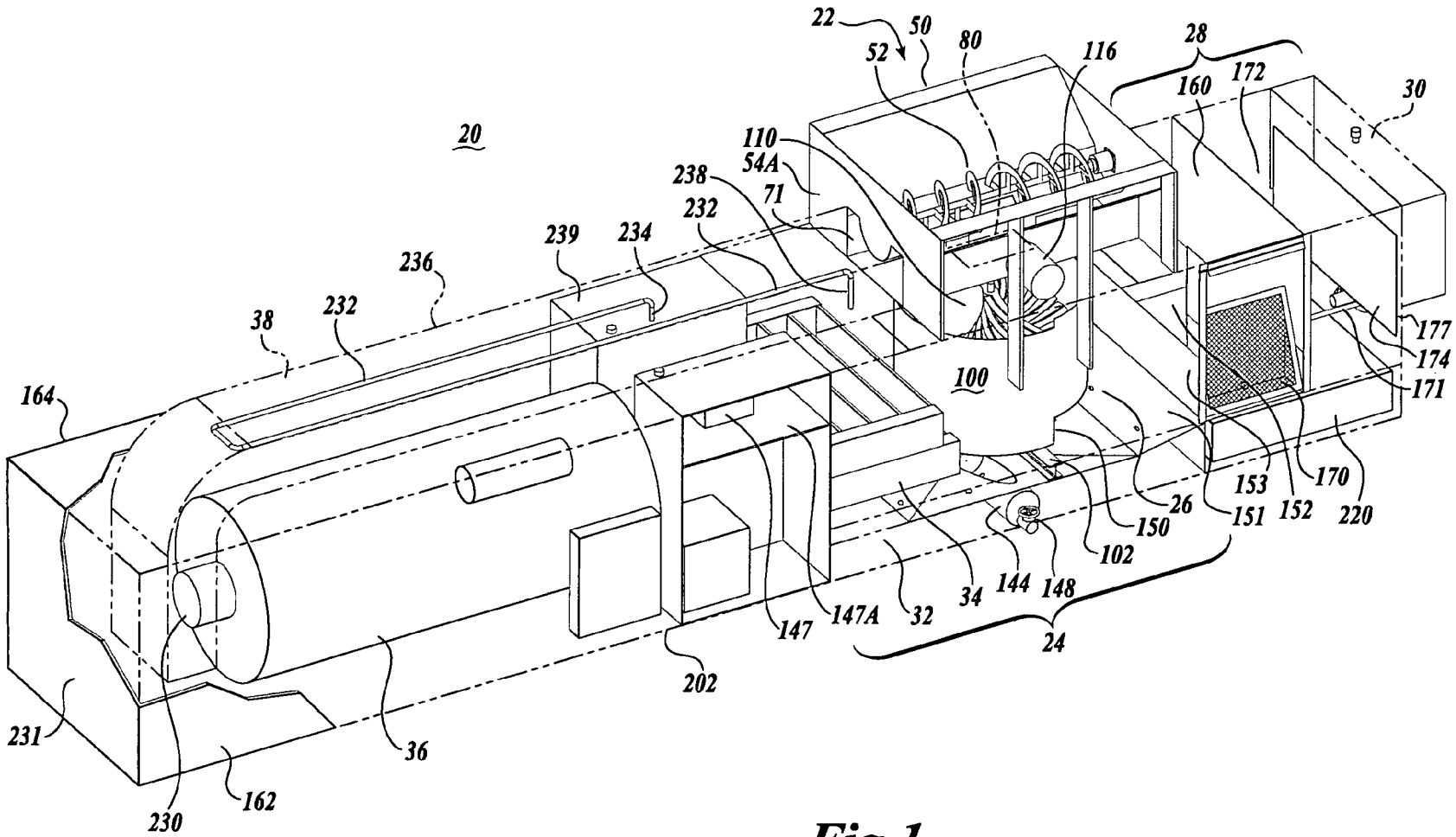
FIG. 1 is an isometric view of the present disclosure, with portions broken away and with other portions shown in phantom to better view the interior of the snow melting apparatus.
Figure 2:
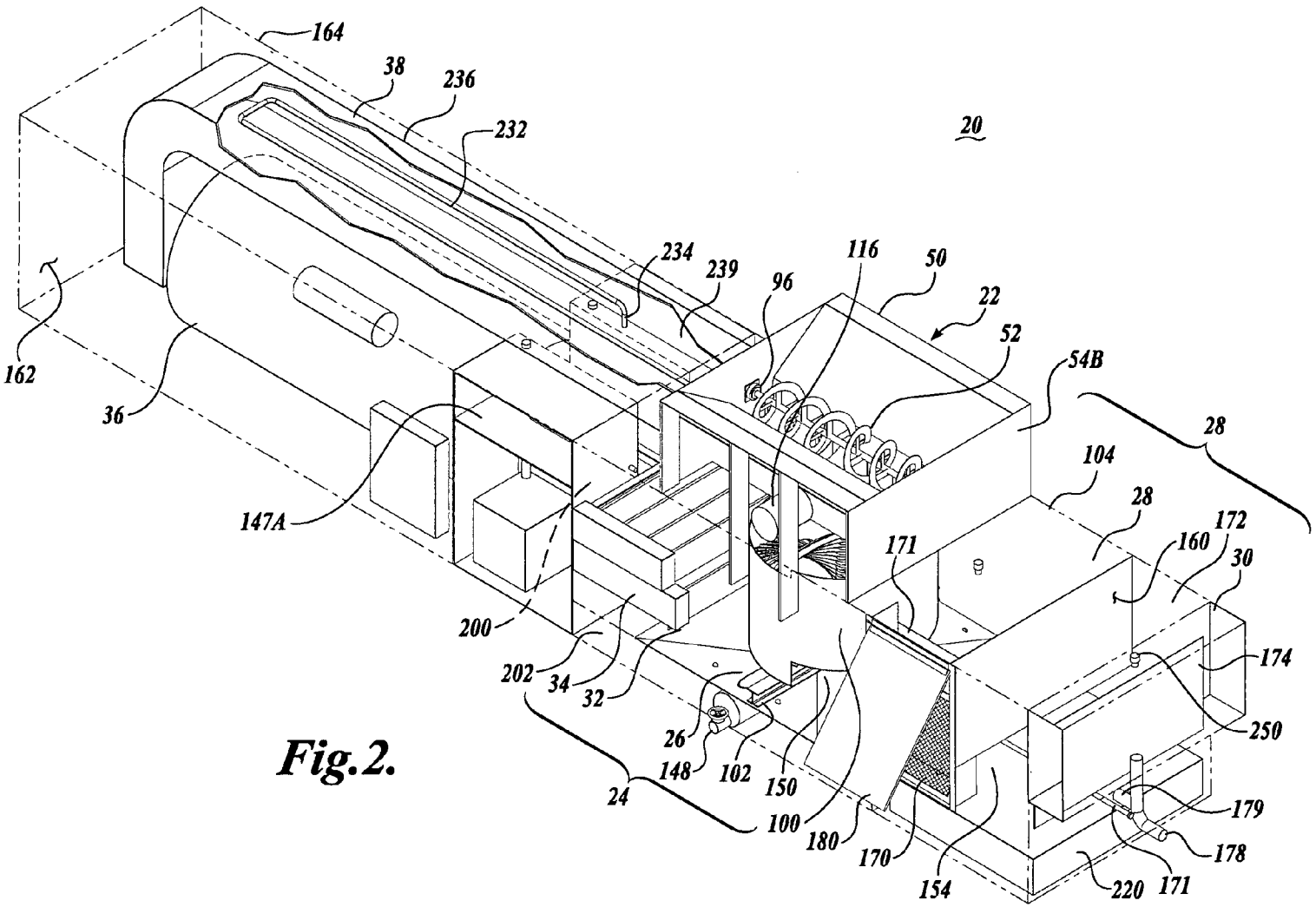
FIG. 2 is a second isometric view taken from the other end of the snow melting apparatus, again with portions shown in phantom and portions broken away to better view the interior portions of the apparatus.

Referring initially to FIGS. 1 and 2, an embodiment of a snow melt apparatus 20 is illustrated. The major components or sections of the apparatus 20 include a snow supply subsystem composed of a snow input hopper assembly 22 for receiving and introducing snow into a snow melting tank 24. The snow from the hopper assembly 22 is mixed with heated water (melted snow) in a melting chamber 26 located in the melting tank 24. A portion of the liquid composed of melted snow and melting water flows from the melting chamber through a discharge subsystem composed of a discharge tank 28 to a discharge manifold 30 from which the liquid is discharged from the apparatus. The remainder of the liquid from the melting chamber 26 is circulated through a heating section 32 of the melting tank to be heated by a heat exchanger 34 and then directed to the top of the melting chamber to melt the incoming snow. The heat exchanger 34 is located in the heating section 32 of the melting tank to heat the water used for melting the snow. A thermal heater 36 provides heated liquid medium that circulates through the heat exchanger 34. If a combustion heater is used as the heater, the exhaust gases from the heater 36 are routed through an exhaust heat exchanger 38 to also assist in heating the melt water in the heating section 32 prior to being routed to the melting chamber 26. The foregoing main section components of the apparatus 20, as well as other aspects of the present disclosure, are described in more detail below.

It is to be understood that when referring to snow in the present disclosure, what is meant is snow alone, as well as snow mixed with ice, or even ice alone.

Figure 3:
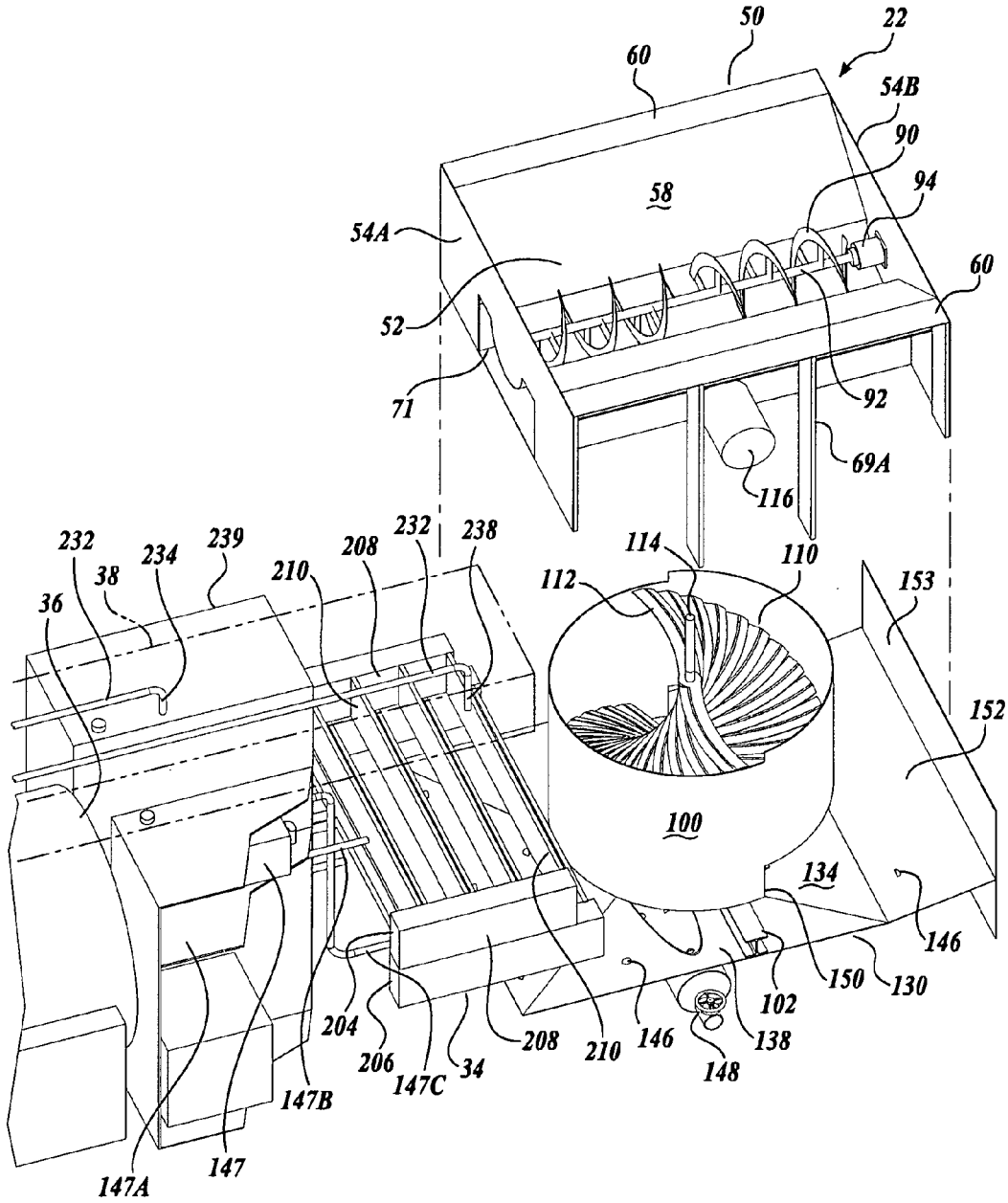
FIG. 3 is an enlarged fragmentary isometric view of a portion of FIG. 1 with portions shown disassembled so as to better view certain aspects of the snow melting apparatus.
Figure 4:
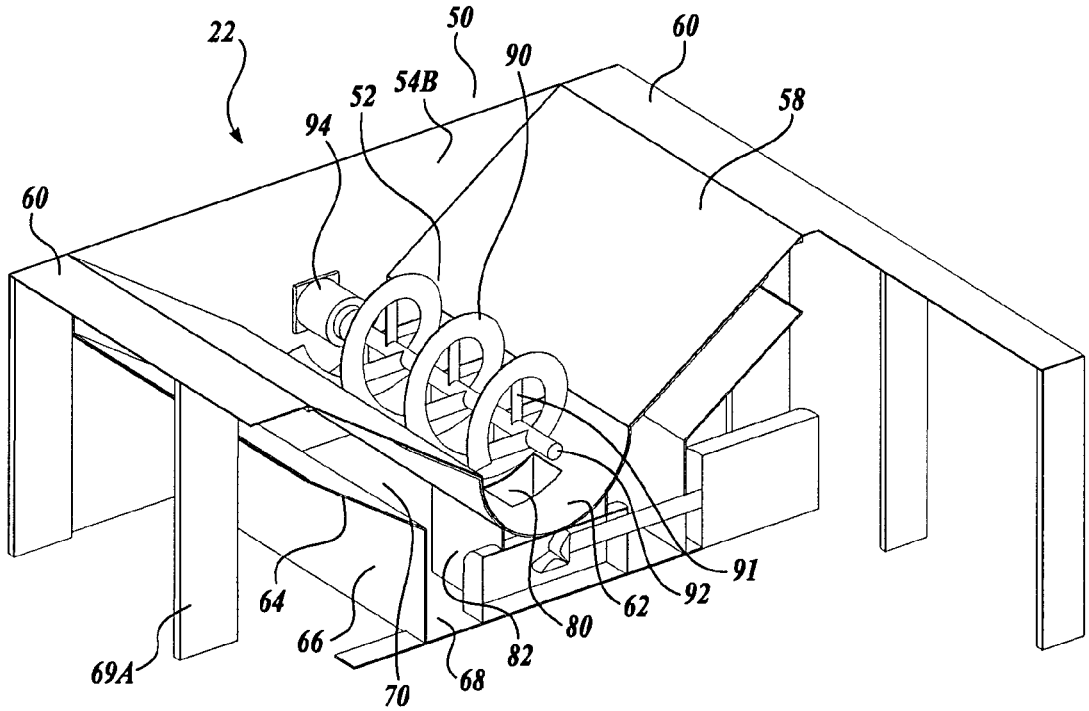
FIG. 4 is an enlarged fragmentary isometric view of FIG. 2, again with portions of the view removed for better clarity.
Figure 5:
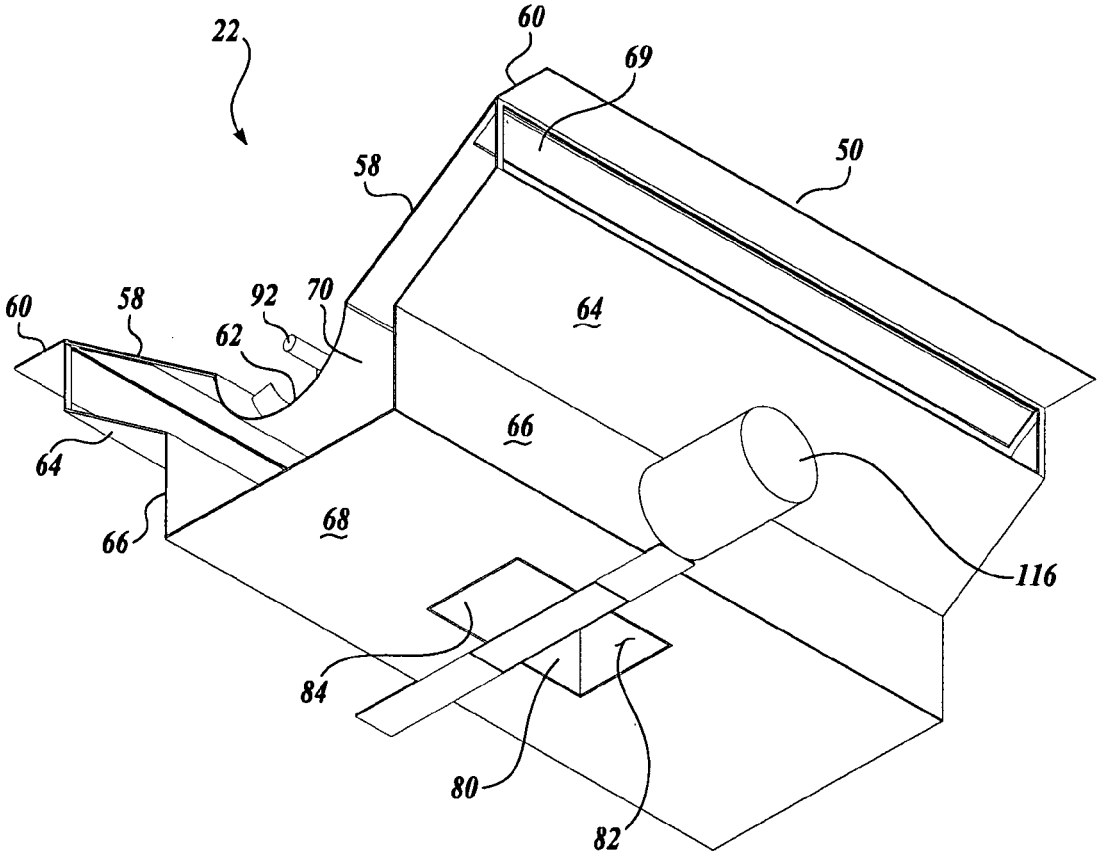
FIG. 5 is an enlarged isometric view taken from the underside of FIG. 4 with portions removed for improved clarity.

The snow input hopper assembly 22, as noted above, supplies snow to be melted to the melting chamber 26 of the melting tank 24. Referring specifically to FIGS. 3, 4, and 5, the hopper assembly 22 includes a hopper structure 50 for receiving the snow to be melted, and a powered auger system 52 to shred or otherwise break up the snow and direct the disassociated snow and ice downwardly into the melting chamber 26. As discussed below, it is desirable to shred or otherwise reduce the snow into relatively small particles sizes, for example to a maximum dimension of about ¼ inch, thereby increasing the surface area of the particles relative to the mass of the particles, which facilitates melting of the snow.

The hopper structure 50 is constructed in a generally rectilinear, box shape having vertical end walls 54A and 54B that form part of the housing structure. Sloped upper walls 58 extend downwardly and inwardly from upper side ledges 60 to join with the upper side edges of an arcuate, longitudinal trough section 62.

The hopper structure 50 also includes lower sloped walls 64 spaced below and disposed generally parallel to corresponding upper sloped walls 58. The lower inward edges of the lower sloped walls 64 meet with the upper edges of vertical walls 66, which extend downwardly to a horizontal floor 68. The upward, outward edges of the sloped lower walls 64 intersect with the lower portions of a perimeter frame 69 that also includes an upper portion that connects to the underside of ledges 60. A series of posts 69A extends downwardly from the underside of the ledges 60 to the top panel 104 of the apparatus, thereby to support and increase the structural integrity of the hopper structure 50.

As will be appreciated, an exhaust plenum 70 is formed by the end walls 54A and 54B and by an upper surface defined by the sloped walls 58, ledges 60, and trough section 62, and a lower surface defined by sloped lower walls 64, lower vertical walls 66, and floor 68. As discussed more fully below, exhaust gas from the thermal heater 36 flows into the plenum 70 through an opening 71 in end wall 54A, through the plenum and then out through exit ports located in the perimeter frame 69 beneath ledges 60, to heat the surfaces of the hopper structure 50, which assists in the process of melting the snow and preventing the snow from adhering to the hopper surfaces, especially the sloped walls 58, trough section 62 and chute 80 described below.

As shown in FIGS. 4 and 5, a chute 80 extends centrally downwardly through the hopper structure 50 through which snow is introduced from the hopper structure 50 to the top portion of the melting chamber 26 of the melting tank 24. The chute 80 is defined by vertical walls 82 and 84 that extend vertically between floor 68 and the underside of trough 62. Although not shown, the chute 80 could be provided with a movable door or closure for transit or storage of the apparatus 20. Although the chute 80 is shown of rectangular cross-section, it can be formed in other shapes, such as square or round.

Referring primarily to FIGS. 2, 3, and 4, the auger system 52 includes the typical circular auger blade 90 mounted on a rotating drive shaft 92 by radial spokes 91. The drive shaft 92 is powered by a hydraulic motor 94 attached to one end of the shaft 92. The other end of the shaft is supported by a bearing assembly 96, see FIG. 2. The blade 90 is of the typical circular configuration consisting of two sections that are "wound on" the shaft 92 in opposite directions, thereby feeding the snow towards the center of the shaft to the location of the chute 80 when the shaft is rotated by motor 94. Appropriate controls are provided for the motor to control the speed of the motor which in turn controls the rate at which snow is fed through the chute 80. Although not shown, the outer cutting edge of the blade 90 could be serrated or toothed, or spikes or teeth added to project from the blades, to assist in shredding the snow.

As shown in FIG. 4, the outer periphery of the auger blade 90 fits fairly close within the trough section 62 so as to prevent build-up of snow and/or ice within the trough. As will be appreciated, the auger 90 in addition to feeding the snow through the chute 80 also serves to shred or otherwise break up the snow and ice into smaller pieces for feeding through the chute 80. It is desirable that the snow and ice be broken into relatively small pieces to facilitate the melting of the snow. The maximum particle size of the snow can be about ¼ inch, but a smaller or larger maximum particle size can be employed. As is well known, the smaller the pieces into which the snow is shredded, the more surface area per piece to be acted on by the heated melt water, thereby increasing the speed at which the snow is melted.

Figure 6:
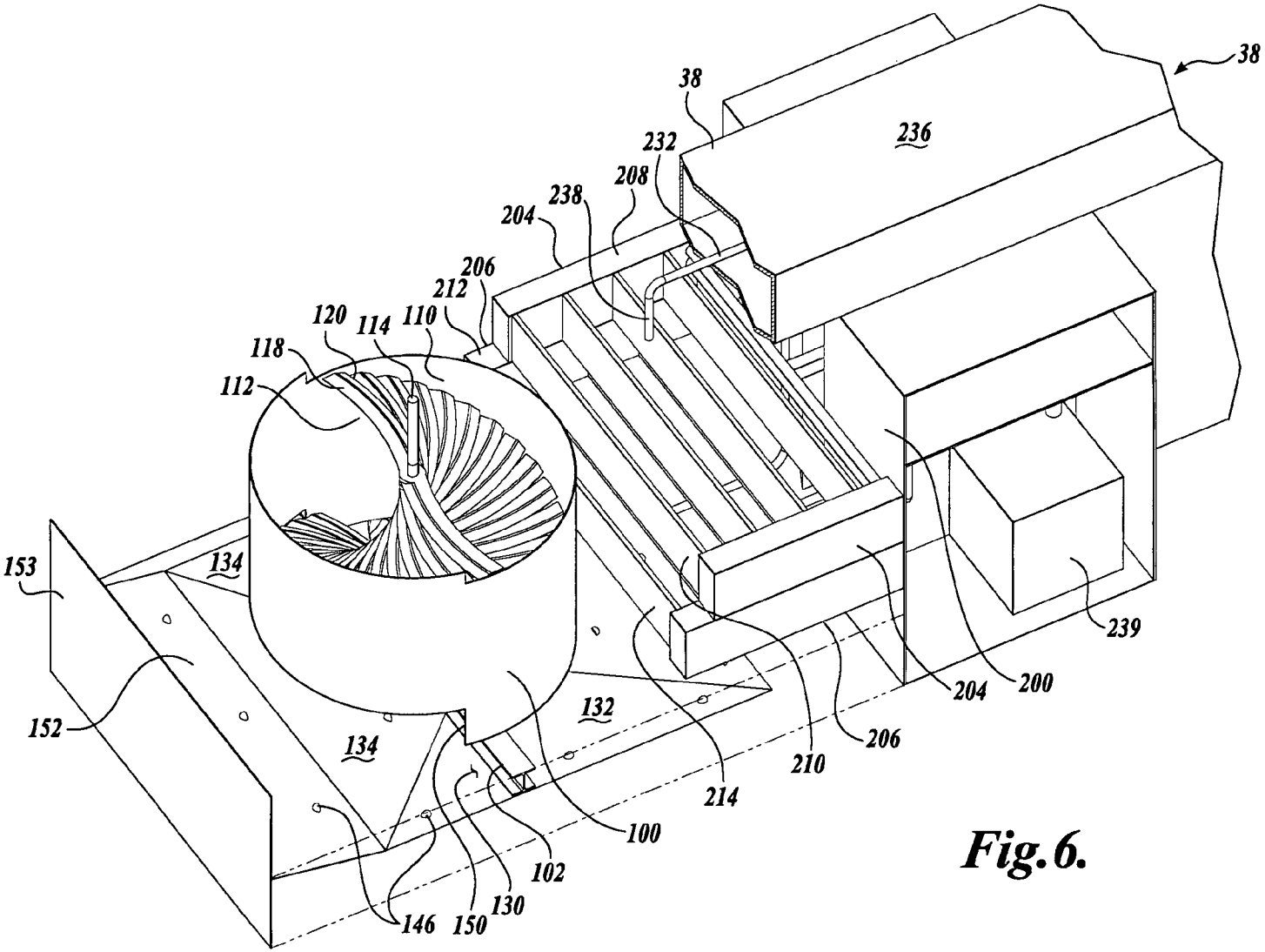
FIG. 6 is an enlarged fragmentary view of FIG. 1 with portions broken away to better illustrate the induction chamber of the snow melting apparatus.
Figure 7:
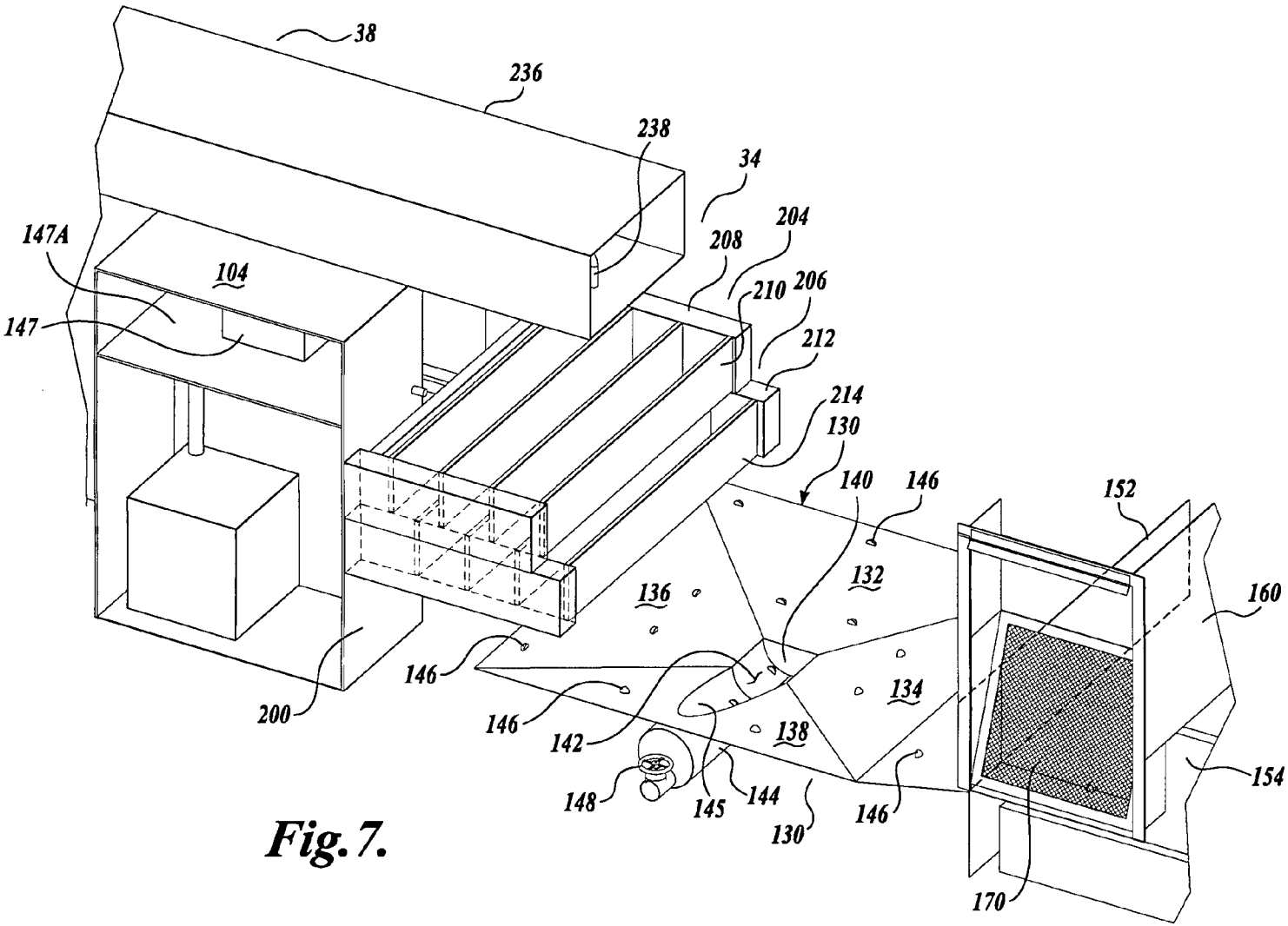
FIG. 7 is an enlarged fragmentary view of FIG. 2, again with portions removed to better view the sediment collection chamber of the snow melting apparatus.

Referring specifically to FIGS. 1-3, 6, and 7, melting chamber 26 of the melting tank 24 includes a vertically oriented, cylindrically shaped induction chamber or duct 100 positioned generally centrally in the main section 26. As shown in FIGS. 1, 3, and 6, the induction chamber 100 is mounted on an underlying cross beam 102, which is illustrated as being in the form of an I-beam. Of course, other structural elements may be utilized in place of the I-beam. Also, rather than using the singular cross beam 102, several cross beams or other structural elements may be employed instead. The induction chamber 100 is located in axial alignment with the center of chute 80 and drive shaft 92 of the auger system 52. The induction chamber may be held in place by extensions of the posts 69A of the hopper structure 50. Such posts can overlap the exterior of the chamber and be attached thereto by standard means. Of course, other methods can be used to help hold the induction chamber in a stable, stationary condition.

The induction chamber 100 extends most of the vertical height between the top surface of cross beam 102 and the underside of top panel 104, extending along the entire length of the apparatus 20. However, a gap is provided between the upper end of the induction chamber and top panel for removal of large objects too buoyant to be carried down the induction chamber. Such top panel 104 may be constructed of several sections rather than being of a single component. It will be appreciated that an opening is formed in the top panel co-extensive with the cross-sectional area of the chute 80 to enable snow from the hopper structure 50 to pass downwardly into the induction chamber 100.

As perhaps best shown in FIGS. 3 and 6, a vertical impeller fan pump 110 is positioned within the induction chamber 100 to closely fit therein. The impeller fan pump 110 includes a series of generally S-shaped fan blades 112 extending in opposite directions, horizontally from the central, rotatably driven fan shaft 114. The upper end of the fan shaft is coupled to a 90° gear box, not shown, which in turn is coupled to the horizontally orientated drive motor 116. The drive motor may be powered hydraulically, electrically, or by any other convenient means. The lower end of the fan shaft 104 is supported by a bearing structure, not shown, carried by cross beam 102.

Referring specifically to FIG. 6, each of the fan blades 112 is composed of two wings or sections configured to together form in a generally S-shape when viewed from above, with a central circular hub section used to fixedly attach the blade to the fan shaft 114. Each blade 112 is illustrated as having a generally horizontal leading section 118 and a downwardly canted or pitched trailing section 120. Forming fan blades in this manner is calculated to drive the snow particles and melting water downwardly through the induction chamber while seeking to not force the snow particles centrifugally outwardly along the blades. Rather, the endeavor is to drive the snow particles substantially vertically downwardly, thereby to maintain a good dispersion of the snow/ice particles across the entire diameter of the induction chamber 100. It will be appreciated that the fan pump 110 acts as a multi-stage pump as well as a mixing apparatus.

It will be appreciated that the pitch and size of the blades 112 and rotational velocity of blades can be designed and selected to produce a desired flow rate of the melt water and snow particles through the induction chamber 100 equal to the input of the snow and melt water. In addition, the diameter of the induction chamber 100 and the size of the impeller fan pump 110 is selected such that the velocity of the melt water moving through the induction chamber 100 produces a sufficient drag on the snow particles suitable to overcome the buoyancy of the particles, thereby distributing the particles in a snow slurry, holding the particles in the upper portion of the induction chamber and also distributing the particles by size. Further, the fan pump 110 creates turbulence appropriate to the mixing process, thereby distributing the heated water over the surfaces of the snow/ice particles.

Although each fan blade 114 is illustrated as composed of two wings or sections extending diametrically opposite from a hub section, it is to be appreciated that each of the fan blades may be composed of a different number of wings or sections, for example, three separate wings or sections radiating outwardly from the shaft 114, or perhaps four or more wings or sections radiating outwardly from the shaft 114.

As also shown in FIG. 6, the fan blades 112 are illustrated as positioned slightly angularly from the next adjacent blade to form a continuous fanned pattern, as viewed in the downward direction. This relative placement of the fan blades is calculated to sequentially drive the snow and water downwardly through the induction chamber. Nonetheless, the fan blades can be positioned in other relative angular orientations to each other.

The bottom of the melting tank 24 is defined by a floor pan structure 130 designed to collect the sand, gravel, or other sediment mixed within the snow. As will be appreciated, sand, gravel, and similar materials are typically applied to a road, street, etc., to help improve the traction of the vehicles traveling over the snow. In some instances, up to 10% of the "snow" may actually be sand, gravel, and similar sediment. Thus, it is important to be able to collect and remove the sediment to keep such sediment from filling up the melting chamber 26 and/or induction chamber 100.

To this end, the floor pan structure 130 is composed of generally triangularly shaped panel sections 132, 134, 136, and 138 that are positioned and orientated relative to each other to be sloped downwardly towards the apex of the panel sections. An opening 140 is formed in the center of the floor pan structure 130 to provide communication with a collection trough 142 extending laterally relative to the floor plan 130 to transition into a circular drain pipe or tube 144. The panel section 138 also includes a cut-out 145 in the shape of a partial ellipse to match a cut-out formed in the upper portion of the drain pipe 144 to allow further communication between the bottom of the melt section 26 and the drain tube 144.

As will be appreciated, the sand, gravel, and other sediment being heavier than water will naturally fall downwardly through the induction chamber 100 and out the bottom thereof to the floor pan 130. A plurality of high-speed water jets 146 is positioned about the floor pan and aimed to discharge high-pressure water towards the opening 140 and cut-out 145, thereby to induce the sediment to flow toward the center of the floor pan and into the collection trough 142 and drain pipe 144. High pressure water is supplied to the jets 146 by a pump 147 positioned in an upper side compartment 147A located between heating section 32 and the heater 36. The pump 147 draws in water through an inlet line 147B and supplies high pressure water to the jets 146 via outlet line 147C. Periodically, the collection trough 142 and drain pipe 144 may be flushed by opening a valve 148 through which the collected sediment is flushed out of the collection trough and drain pipe. Of course, other methods and systems may be utilized to collect and remove sediment from the apparatus 20, the foregoing being only one example of how this may be accomplished.

As noted above, a portion of the melted snow and water used for melting the snow that is driven downwardly through the induction chamber 100 by the fan pump 110, now free from sediment, is directed in the right-hand direction, as shown in FIGS. 1 and 2, for discharge from the apparatus 20. A bottom cut-out 150, in the form of a diametrical notch, is formed in the lower right side of the induction chamber 100 to direct buoyant materials in the right-hand direction from the bottom of the induction chamber to the discharge tank 28. The liquid composed of the melted snow and melt water flows through the transit section 151 of the melting tank 24 into a skim chamber 152 of the discharge tank 28. The skim chamber is formed by a first cross wall 153 and a second cross wall 160. The skim chamber 152 functions as a skim trap to collect floating objects and impurities, such as oil, in the melted snow and water. The first cross wall 153 extends across the discharge tank 28 and upwardly from a floor 154 to or above the elevation of the top of the heat exchanger 34. This enables the water in the melting tank to be drawn down to this level and also allows the discharge tank to be completely evacuated for transit or storage of apparatus 30.

Water from the melting tank 24 is required to flow over the wall 153 and into the skim chamber 152. As perhaps best shown in FIGS. 1 and 2, the skim chamber 152 includes a screen or filter 170 that removes oil or other floating "impurities" from the water. The screen is located at the front side of the skim chamber 152, as viewed in FIGS. 1 and 2. A skim weir, 172, is located upstream from the screen 170 to block off the screen for cleaning during operation of the apparatus 20. Although not shown, just downstream of screen 170 is located an outlet that directs the flowing liquid from the skim trap into a line 171 that ties into discharge or outlet pipe 178 discussed below. As will be appreciated, Bernoulli effect is relied upon to draw the melted snow through the screen 170 for filtration thereof and then out through line 171. As shown in FIG. 2, a front panel or door 180 is provided to gain access to the filter 170 to replace or clean the filter.

The discharge tank also includes a discharge chamber 172 defined between the second vertical cross wall 160 and a discharge manifold 30. The cross wall 160 spans between the side walls 162 and 164 of the overall apparatus 20. As with the top panel 104, the side walls 162 and 164 may be constructed of several sections rather than as a singular structure. As shown in FIGS. 1 and 2, cross wall 160 extends to the top of the discharge tank 28, whereas at its lower edge, the wall 160 is spaced above the floor 154. It would be appreciated that the wall 160 allows the liquid to flow beneath the wall but blocks floating materials.

The liquid that flows beneath wall 160 pass into a discharge chamber 172, located to the right of cross wall 160. The opposite side of the discharge chamber is defined by the discharge manifold 30 and lower end wall 177. A drain, 179, is provided in the discharge chamber 172 to enable the discharge tank 28 to be drained, as well as to partially drain the melting tank for transit or storage.

The liquid in the discharge chamber 172 flows over a wier 174 located along wall 177, and then into the discharge manifold 30 located just outside the end wall 177. The height of the wier 174 can be vertically adjusted to adjust the level of the melt water and snow in the melting chamber 26 as desired. The liquid is discharged from the discharge manifold 30 through a discharge pipe or outlet 178.

Referring primarily to FIGS. 1-3, 6, and 7, the heating section 32 of the melting chamber 26 includes a heat exchanger 34, located in the heating section, positioned adjacent end wall 200 and also alongside the induction chamber 100. The heat exchanger is also located vertically between a bottom panel 202 for the apparatus 20 and the top panel 104. The heat exchanger 34 consists of an upper bank 204 and a lower bank 206 similarly constructed. In this regard, the upper bank 204 includes end manifolds 208 that are in fluid flow communication with transverse heating elements 210, each in the form of a hollow rectangular tubular structure. The lower bank 206 similarly is composed of end manifolds 212 and a plurality of heating elements 214 spaced along the lengths of the heating manifolds. The heating elements 210 and 214 are vertically disposed, but can be in other orientations, for example, diagonally disposed relative to the vertical direction. Also, the lower heating elements 214 are illustrated as spaced approximately centrally between two corresponding upper heating elements 210. Of course, a different spacing arrangement may be utilized if desired. Also, rather than utilizing upper and lower banks 204 and 206, a fewer or greater number of heat exchanger banks may be employed.

The heating elements 210 and 214 are illustrated as of hollow rectangular cross-section. Other cross-sectional shapes may be utilized, such as round or triangular. Also, the exterior surface of the heating elements 210 and 214 may be smooth, textured, for instance, ribbed, dimpled, etc., or of numerous other configurations or treatments to achieve desired heat transfer characteristics with the water being heated. Further, the heating elements may be composed of different metals, alloys, or combinations, for instance, the heating elements may be composed of stainless steel, copper, aluminum, etc.

The heating medium utilized in conjunction with the heat exchanger 34 is heated by a heater 36 located at the right-hand end portion of the apparatus 20, as seen in FIGS. 1 and 2. The heater 36 can be of many configurations. Such heaters are articles of commerce, and thus, will not be described in particularity here. Possible types of heaters may include thermal fluid heating systems that are fired by fuel oil, diesel, or other petroleum fuel. The fuel is stored in a tank 220 located beneath the floor 154 of the discharge tank 28 of the melting tank 24.

The heating medium heated by the heater 36 may be an oil-based liquid. The heating medium may also be of other compositions, such as ethylene glycol. The liquid heating medium may be transmitted between the heat exchanger 34 and heater 36 by transfer lines in a standard manner.

The combustion exhaust from the heater 36 is utilized in exhaust heat exchanger 38 to assist in heating the water in the melting tank 24. To this end, the exhaust from the heater 36 is routed out the end of the heater and into the adjacent vertical end section of the exhaust heat exchanger 34 by the transfer duct or pipe 230. The pipe extends outwardly from the left end of the heater 36 into the left end portion of the exhaust heat exchanger 38, which is shown as located just inside the left end panel 231. The exhaust heat exchanger 38 is illustrated as including an elongate rectangular plenum 236 having a left end portion that curves downwardly to overlap the end of the heater 36. The heat exchanger housing receives the exhaust gas from the heater 36 at its left-hand end, and once the exhaust travels through the plenum, the exhaust gas is thereafter routed through a second plenum 70 formed in hopper structure 50, from where exhaust gas is expelled to the ambient, as noted above.

The exhaust heat exchanger 38 may be of a standard three-coil design that routes water from the lower portion of the melting tank 24 through a heat transfer tube or duct 232 that extends from an inlet line 234, along the length of the plenum 236 of the heat exchanger 38 and then back along the length of the plenum to an outlet line 238 to discharge such water heated by the heater exhaust to the upper portion of the melting chamber 26. A pump 239, see FIG. 6, is employed to circulate the water to be heated through the exhaust heat exchanger 38. It is expected that the exhaust gas from the heater 36 may be as high as 600° F., which is substantially higher than the temperature of the water from the bottom portion of the melting chamber 26; thus the overall efficiency of the snow melt apparatus 20 can be substantially increased via the exhaust heat exchanger 38.

Describing the operation of the apparatus 20, snow and ice to be melted is delivered to the hopper assembly 22. Such snow and ice are shredded or otherwise reduced into relatively small particles by auger blade 90, which also feeds the snow particles downwardly through central chute 80 and into the open top portion of vertical induction chamber 100. With the snow from the hopper structure 50, heated water is also introduced into the upper portion of the induction chamber 100; to this end, the upper end portion of the induction chamber is "notched" in the diametrically left-hand portion thereof so as to induce the heated melt water to enter the induction chamber from the left-hand direction.

Although different proportions of snow and water may be introduced into the induction chamber, in one exemplary mode of operation, the amount of snow and water may be substantially equal in mass. The snow and water mixture is agitated and forced downwardly into the induction chamber 100 by the vertical impeller fan pump 110. The fan pump 110 not only causes the heated water and snow particles to mix together for optimum melting, but also seeks to drive the buoyant snow particles downward into the water column within the induction chamber. Typically, the snow particles, being lighter than water, would tend to remain at the upper portion of the induction chamber. The speed of rotation of the impeller fan pump 110 can be varied so as to control the speed that the snow/ice particles are forced downwardly through the induction chamber. Such speed may depend on the temperature of the snow to be melted. As will be appreciated, snow at a lower temperature will require a longer period of time to melt for a given hot melt water temperature and quantity.

Also the buoyancy of the snow particles as a cube function of the volume of the snow particles, thus the larger snow particles are less effected by the speed of the melt water drawn through the induction chamber. As such the flow speed of the melt water can be selected so thus the smallest snow particles, that traveled with the melt water, melt as they reach the bottom of the induction chamber. The larger particles will tend to stay in the upper end of the induction chamber until they melt sufficiently to be drawn down to the induction chamber by the melt water.

The snow that is melted within the induction chamber 100 flows out the bottom of the induction chamber in two different directions. In a first direction, a portion of the melted snow and melt water flows in the right-hand direction shown in FIGS. 1 and 2 into and through discharge tank 28, past filter or screen 170, and into discharge chamber 172. From the discharge chamber 172, the liquid passes over wier 174 into discharge manifold 30. Typically, the temperature of the water in the discharge manifold 30 will be slightly above freezing, for example, in the range of 33° F. to 35° F., so as to properly flow out of the tank 30 through outlet pipe 178.

The portion of the liquid from the bottom of the induction chamber 100 that flows in the right-hand direction is a function of the amount of snow being melted in the induction chamber. This liquid from the induction chamber is discharged via the discharge manifold 30. A portion of the liquid from the induction chamber is recirculated in the left-hand direction and up through the heat exchanger 34 to be heated to a temperature, typically in the range of about 50° to 80° (but other heating temperatures can be used that are cooler or warmer than this range, depending on the proportion of snow to water in the induction chamber, the temperature of the snow, and other variables), and introduced into the upper portion of the induction chamber 100 from the left side of the chamber. Also, as discussed above, a portion of the water within the lower portion of the melting tank 24 is heated via the exhaust heat exchanger 38 and then introduced into the upper portion of the melting chamber 26 through outlet pipe 238 located at the right-hand end of the exhaust heat exchanger 34.

Although the temperature to which the heated water introduced into the top of the melting chamber may vary, in one embodiment of the present disclosure, it is contemplated that the water be at approximately 53° F. The temperature of the water can be monitored in discharge manifold 30 and the temperature of the water adjusted by various methods, including by controlling the amount of snow allowed to enter induction chamber 100. Alternatively, the heat of heat exchanger 34 can be varied as necessary to achieve the desired temperature of the water discharged from manifold 30. Assuming that the snow introduced into the hopper structure 50 is at 18° F., equal amounts of snow and water could be introduced into the induction chamber with the result that the liquid exiting the induction chamber would be at approximately 33° F. It is possible to only heat the liquid to this temperature and still have such liquid successfully discharge from the apparatus 20 because the apparatus 20 is of substantially closed design. Top panel 104, side panels 162 and 164, end panels 177 and 231, and bottom panel 202 together form the closed housing of apparatus 20. Thus, no substantial portion of the snow melting tank 24 is open to the environment, other than perhaps via chute 80 formed in the snow input hopper assembly 22; however, such chute is typically filled with snow, and thus, the upper end of the melting chamber 26 of the snow melting tank 24 is not actually open to the environment. Any cold air that might be introduced into the melting tank 24 is vented back out through an inlet air vent 250, located in the top panel 104 at a position above discharge tank 28, see FIG. 2.

Also, the exterior panels and walls of the apparatus 20 may be insulated by conventional means to retain heat within the apparatus and insulating the apparatus from the cold environment. In this regard, insulating foam or other thermal resistant material may be applied to the inside surfaces of the exterior panels of the apparatus 20.

Applicant has calculated that the amount of heat needed to melt the snow at 18° F. received at apparatus 20 is approximately 20 BTUs per pound of snow, utilizing the present apparatus. This amount of heat, via the present apparatus, is efficiently generated and mixed with the snow to be melted. Consequently, the present apparatus is capable of melting a substantial volume of snow per unit quantity of fuel fed to the heater 36.

Although a particular embodiment of the present disclosure is illustrated and described, it is to be understood that various changes and substitutions of the foregoing described apparatus 20 and components thereof may be utilized. As noted above, a different type of heat exchanger 34 can be utilized as well as a different type of heater. Further, the construction of the exhaust heat exchanger 38 may differ from that described above and still satisfactorily function with respect to the apparatus 20. In this regard, the heat exchanger might be heated not by a fuel per se, but instead by electric energy. Such changes might be made depending on the available sources and costs of energy, and the desired overall size of apparatus 20. For example, if the apparatus is to be mounted on a vehicle to melt snow while the snow is being scooped off a street or road, then the apparatus will need to be of a size that might be smaller than if the apparatus is stationary at a snow dump or storage site.

Also, the configuration of the impeller fan pump blades 112 may differ from that illustrated and described. In this regard, each of the fan blades 112 may be of two, three, four, or other number of sections. In addition, the overall shape or configuration of the fan blades 112 may differ from that illustrated and described above.

Further, the induction chamber 100 may be in a shape other than cylindrical, especially if a method other than an impeller fan pump is used to drain the melt water and snow through the induction chamber and effect good mixing of the melt water and snow particles to maintain good dispersion of the snow in the induction chamber. Such other methods might include, for instance, water jets. Such water jets might be of various types and sizes and placed at various locations in the induction chamber. If such water jets are used, the induction chamber might be of elliptical cross-section, oval cross-section, or other cross-section.

Although not so illustrated, the apparatus 20 may include an internal frame structure for supporting the apparatus. Such frame structure can be of any conventional construction. In this construction the various exterior panels and walls, described above, can be in the form of insulated panels mounted to the exterior of the frame structure. Also, the apparatus may be mounted or built on the frame of a transport vehicle or trailer so as to be transportable from site to site as needed. Further, the components of the apparatus 20 may be positioned in other locations relative to each other. For example, the heater 36 need not extend laterally from the left side of the heater 36, but rather, may be positioned at another location, perhaps alongside the melting tank 24, or beneath the melting tank 24. In addition, the heater may be located separately from the melting tank 24 with lines leading from the heater to the melt chamber for the heating medium to flow between the heater and heat exchanger 34. Likewise, the melt water heated in the exhaust heat exchanger 38 may be transmitted to and received from the melting tank 24 through insulated lines. In this manner, the apparatus 20 may be of modular construction with different heater and exhaust heat exchanger combinations utilized with the apparatus.

The embodiments of the invention in which an exclusive property or privilege is claimed are defined as follows:

1. A method for melting snow, comprising:

a. shredding the snow;

b. mixing the shredded snow with heated melting water within an upright induction chamber positioned within a melting chamber filled with water and simultaneously drawing the melting water and snow downwardly through the induction chamber with a fan pump disposed in the induction chamber, the fan pump comprising a plurality of spaced-apart blades positioned along the length of the induction chamber;

c. discharging a portion of the liquid composed of the melted snow and melting water expelled from the induction chamber via the fan pump forcing a portion of the liquid through a discharge subsystem; and d. reheating a portion of the liquid composed of the melted snow and melting water expelled from the induction chamber in a heating subsystem and directing such heated liquid back into the induction chamber for use in melting additional snow via the fan pump forcing a portion of liquid composed of the melted snow and melting water through the heating subsystem and back into the induction chamber.

2. The method according to claim 1, wherein the melting water is drawn through the induction chamber at a speed to overcome the buoyancy of the snow within the induction chamber to prevent the snow from accumulating from the top portion of the induction chamber.

3. The method according to claim 1, wherein the snow is drawn through the induction chamber, substantially uniformly across the width of the induction chamber, so as not to accumulate at any specific location across the width of the induction chamber.

4. The method according to claim 1, further comprising:

a. using a combustion system to heat a portion of the liquid expelled from the induction chamber; and b. using the combustion products from the combustion system to also heat a portion of the liquid expelled from the induction chamber and introducing such heated liquid into the induction chamber.

5. A snow melting system utilizing heated melting water to melt snow, comprising:

a. a melting tank, comprising:

i. a melting chamber located in the melting tank, the melting chamber comprising a generally upright induction chamber, said induction chamber having a width and defining an upper inlet end portion adapted to receive snow and heated melting water, and a lower outlet end portion adapted to discharge liquid from the induction chamber consisting of the melting water and melted snow; and ii. a fan pump comprising at least one rotatable fan blade disposed in the induction chamber to occupy substantially the entire width of the induction chamber and configured to draw the melting water and snow downwardly through induction chamber and simultaneously mix the melting water and snow;

b. a discharge subsection for draining a portion of the liquid from the outlet end portion of the induction chamber for expulsion from the melting tank;

c. a melting water heating subsystem for heating a portion of the liquid discharged from the outlet end portion of the induction chamber and supplying such liquid after heating to the upper inlet end portion of the induction chamber, and d. said fan pump pumping the liquid discharged from the induction chamber through the discharge subsystem for expulsion from the melting tank, said fan pump also pumping the liquid discharged from the induction chamber through the melting water heating subsystem for heating a portion of the discharged liquid and routing such liquid after heating to the upper inlet end portion of the induction chamber.

6. The system according to claim 5, wherein at least a portion of the melting water heating subsystem is located within the melting tank.

7. The system according to claim 6, wherein the melting water heating subsystem comprises a first heat exchanger located within the melting tank and positioned so that a portion of the liquid expelled from the outlet end portion of the induction chamber passes through the first heat exchanger and thereafter flows into the upper inlet end portion of the induction chamber.

8. The system according to claim 7, wherein the melting water heating subsystem further comprising a heater for heating liquid heating medium that circulates through the first heat exchanger.

9. The system according to claim 8, wherein the melting water heating subsystem further comprising a second heat exchanger for heating a portion of the melting water in the melting tank; said second heat exchanger comprising:

a. a plenum chamber through which flows exhaust gases from the heater; and b. ducting located within the plenum chamber for circulating melting water through the plenum chamber for the heating of the melting water by the exhaust gases of the heater.

10. The system according to claim 5, further comprising a snow supply subsystem to shred snow and supply the shredded snow to the upper inlet end portion of the induction chamber.

11. The system according to claim 10, wherein the snow supply subsystem comprises:

a. a hopper for receiving snow to be melted; and b. an auger system to shred the snow in the hopper and feed the shredded snow into the induction chamber.

12. The system according to claim 11, wherein:

a. the melting water subsystem generates combustion gas; and b. the hopper comprising a housing for receiving the snow to be melted, the housing being at least partially hollow to define a plenum for receiving the combustion gas from the melting water heating subsystem to heat the housing.

13. The system according to claim 5, wherein the induction chamber is generally cylindrical and having:

a. an open upper end portion serving as the inlet for the induction chamber; and b. an open lower end portion serving as the outlet for the induction chamber.

14. The system according to claim 13, wherein the fan pump comprising a plurality of fan blades spaced along the length of the induction chamber, said fan blades shaped to draw the melting water and snow down through the induction chamber while creating a condition within the induction chamber wherein the force vector on the snow from the melt water is greater in the direction along the length of the induction chamber than in the direction radially outwardly relative to the diameter of the induction chamber.

15. The system according to claim 5, wherein the fan pump comprising a plurality of fan blades, said fan blades:

a. spaced along the length of the induction chamber;

b. sized to sweep an area that corresponds to substantially the entire cross-sectional area of the induction chamber; and c. are configured to draw the buoyant snow downwardly through the induction chamber within the melting water and mix the snow within the melting water.

16. A snow melting apparatus for melting snow with heated melting water, some of the heated melting water composed of previously melted snow, said apparatus comprising:

a. a melting tank for receiving snow and heated melting water for melting the snow;

b. an induction chamber located within the melting tank, said induction chamber having an upper opening for receiving the snow to be melted and the heated melting water, and a lower opening for discharging the liquid composed of the melted snow and melting water;

c. a first heat exchanger disposed within the melting tank, the first heat exchanger comprising heating elements disposed at an elevation primarily between the upper opening of the induction chamber and the lower opening of the induction chamber to enable liquid discharge from the lower opening of the induction chamber to flow over the heating elements to be heated prior to flowing into the upper opening of the induction chamber;

d. an outlet in liquid flow communication with the melting chamber for expelling from the melting apparatus a portion of the liquid that is discharged from the lower opening of the induction chamber; and e. an induction fan pump disposed within the induction chamber, said fan pump having a plurality of vertically spaced-apart fan blades positioned along the length of the induction chamber, said fan blades of a configuration to draw the buoyant snow down through the melting water within the induction chamber and simultaneously mix the snow and melting water, thereby melting the snow, said fan pump pumping the liquid discharged from the induction chamber out through the outlet for expulsion from the melting tank, said fan pump also pumping the liquid discharged from the induction chamber over the heating elements for heating the discharged liquid and routing such liquid after heating into the upper opening of the induction chamber.

17. The apparatus according to claim 16, wherein:

a. the induction chamber is cylindrical in configuration; and b. the fan blades of the fan pump sweep substantially the entire cross-sectional area of the cylindrical induction chamber, said fan blades being shaped to induce a force vector on the liquid within the induction chamber, which force vector is greater in the direction along the axis of rotation of the fan blades than in the direction transversely to the axis of rotation of the fan blades, thereby urging the buoyant snow to flow along the length of the cylindrical induction chamber.

18. The apparatus according to claim 16, further comprising:

a. a heating medium that is circulated through the heating elements of the first heat exchanger;

b. a combustion heater for heating the heated medium; and c. a second heat exchanger comprising a plenum through which the combustion gas from the combustion heater flows, and a circulation system for circulating melting water from the melting tank through the plenum to be heated by the combustion gases of the heater and discharging the heated melting water into the upper portion of the melting tank.

19. A snow melting system utilizing heated melting water to melt snow, comprising:

a. a melting tank, comprising:

i. a melting chamber located in the melting tank, the melting chamber comprising a generally upright induction chamber, said induction chamber defining an upper inlet end portion adapted to receive snow and heated melting water, and a lower outlet end portion adapted to discharge liquid from the induction chamber consisting of the melting water and melted snow; and ii. a fan pump comprising at least one rotatable fan blade disposed in the induction chamber and configured to draw the melting water and snow downwardly through the induction chamber and simultaneously mix the melting water and snow;

b. a discharge subsection for draining a portion of the liquid from the outlet end portion of the induction chamber for expulsion from the melting tank, said discharge subsystem comprising a skim chamber to collect objects that may be floating in the liquid discharged from the outlet end portion of the induction chamber, said skim chamber comprising:

i. a first wall over which the liquid from the induction chamber flows;

ii. a filter through which the liquid within the skim chamber flows;

iii. an outlet for the skim chamber to discharge the liquid that flows past the filter; and iv. a second wall under which liquid from the skim chamber flows to exit the skim chamber for discharge from the snow melting system; and c. a melting water heating subsystem for heating a portion of the liquid discharged from the outlet end portion of the induction chamber and supplying such liquid after heating to the upper inlet end portion of the induction chamber.

20. The system according to claim 19, wherein the discharge subsystem further comprising a discharge chamber, said discharge chamber defined in part by:

a. the second wall of the skim chamber on one side;

b. on the opposite side of the discharge chamber by a discharge manifold for receiving the liquid prior to discharge from the snow melting system; and c. a weir disposed between the discharge chamber and the discharge manifold, said weir adjustable to adjust the elevation of the liquid in the melting tank.

21. A snow melting system utilizing heated melting water to melt snow, comprising:

a. a melting tank, comprising:

i. a melting chamber located in the melting tank, the melting chamber comprising a generally upright induction chamber, said induction chamber defining an upper inlet end portion adapted to receive snow and heated melting water, and a lower outlet end portion adapted to discharge liquid from the induction chamber consisting of the melting water and melted snow; and ii. a fan pump comprising at least one rotatable fan blade disposed in the induction chamber and configured to draw the melting water and snow downwardly through the induction chamber and simultaneously mix the melting water and snow;

b. a discharge subsection for draining a portion of the liquid from the outlet end portion of the induction chamber for expulsion from the melting tank;

c. a melting water heating subsystem for heating a portion of the liquid discharged from the outlet end portion of the induction chamber and supplying such liquid after heating to the upper inlet end portion of the induction chamber; and d. a sediment collection system to collect sediment carried in the snow, said sediment collection system comprising a collection trough positioned beneath the induction chamber and a high-pressure water ejection system to supply high-pressure water to locations beneath the induction chamber to direct the sediment to the collection trough.

* * * * *